US006725478B2

(12) United States Patent
Birch

(10) Patent No.: US 6,725,478 B2
(45) Date of Patent: Apr. 27, 2004

(54) QUILT ASSEMBLY

(75) Inventor: Betty Birch, Shailer Park (AU)

(73) Assignee: Catherina Greenfield, Queensland (AU)

( * ) Notice: Subject to any disclaimer, the term of this patent is extended or adjusted under 35 U.S.C. 154(b) by 0 days.

(21) Appl. No.: 10/176,208

(22) Filed: Jun. 21, 2002

(65) Prior Publication Data

US 2003/0233706 A1 Dec. 25, 2003

(51) Int. Cl.[7] ..... A47G 9/02
(52) U.S. Cl. ..... 5/502; 5/500; 5/485
(58) Field of Search ..... 5/482, 485, 500, 5/502, 486

(56) References Cited

U.S. PATENT DOCUMENTS 4,839,934 A * 6/1989 Rojas ..... 5/502
5,249,323 A * 10/1993 Kikuchi et al. ..... 5/502

* cited by examiner

*Primary Examiner*—Teri Pham Luu
*Assistant Examiner*—Fredrick Conley
(74) *Attorney, Agent, or Firm*—Millen, White, Zelano & Branigan, P.C.

(57) ABSTRACT

A quilt assembly is divided into pockets (10), each containing a removable fabric sleeve (24) containing fill. Sleeves can be individually laundered and dried. Connectors in the sleeve (24) maintain a substantially flat profile to stabilise the shape of the sleeve and reduce unwanted fill movement.

12 Claims, 1 Drawing Sheet

QUILT ASSEMBLY

TECHNICAL FIELD OF THE INVENTION

This invention relates to a quilt assembly configured to maintain shape and stabilise fill within the assembly.

BACKGROUND TO THE INVENTION

Quilts are commonly constructed as a fabric bag to contain thermal insulation, with a series of parallel stitch runs which divide the bag into mutually parallel tubes in order to prevent undesirable movement of the insulation between adjacent tubes. The insulation tends to migrate within a tube during use and accumulate in dense clumps in corners.

Laundering operations present problems because quilts are often too large to fit into a domestic washing machine or tumble dryer. Drying in the open air may take a long time. During such periods, water stains may appear and spoil the appearance. The growth of bacteria and moulds within the fill may generate unpleasant odours. Dry-cleaning the entire article to remove minor marks such as drink stains is costly.

Manufacturers attempt to minimise this laundering disadvantage by provision of an envelope which can be laundered frequently, but the problems of migrating fill, slow drying and allergic responses in susceptible people remain.

OUTLINE OF THE INVENTION

In one aspect of the invention provides a quilt assembly having multiple, elongated compartments holding fill wherein each compartment has an upper surface and an opposed surface, the surfaces extending generally parallel to the plane of the quilt when the quilt is laid out flat, the fill being spread along the compartment between the surfaces, flexible connector means within the compartment and bridging between the surfaces, the connector means constraining the compartment to a substantially flat profile but permitting manual manipulation of fill along the compartment, the dimensions of the compartment and the length of the connector means being selected to maintain the substantially flat profile and thereby stabilise fill within the compartment in order to resist its migration in use.

The flexible connector means may be inserted at or near the centre of the compartment but better control is attained with multiple (eg. pairs) of longitudinally spaced connectors, typically at quarters or thirds of the compartment length. The connector means may be a cross wall. A cross wall of up to half the cross section of the compartment is feasible, allowing the remaining half of the cross section for charging the compartment with fill. Effective control of fill movement is obtainable with a cross wall of less than half the cross section and we have found that a fabric band of 15–35 mm width sewn across the centre axis of the compartment is useful for this purpose. In another embodiment there are laterally spaced pairs of bands located along the length of the compartment.

Clearly the connector function maintaining shape may be achieved without the connector providing any substantial blocking function to longitudinal movement of fill. In this arrangement the assembly relies solely on the stabilising function afforded by connector retaining the flat profile of the compartment.

In another more preferred aspect the invention comprise a quilt divided into pockets, wherein each pocket receives a removable fabric sleeve containing fill. Each sleeve has connectors between opposed surfaces as previously described in relation to the compartments of the first aspect, the sleeves effectively each form a removable compartment whereas in the first aspect the compartments were fixed. The sleeves may be locatable within the pockets by fasteners. Fasteners such as studs or hook and pile strips are useful. The ends of the sleeves may be arcuate in order to leave no corner into which the fill may become trapped. A semicircular closing run is convenient for this purpose. When stitched into a square ended sleeve, the curve leaves a pair of ears which may readily act as location sites for the fasteners.

The sleeves may be made of a single rectangular pattern piece joined by a single seam (or other known closures such as tape or the like). Alternatively, two like superimposed pieces may be joined by a seam around the perimeter thereof. The seams are preferably outwardly facing in order to create drag relative to the pocket in which the sleeve is accommodated, thereby stabilising the sleeve in the compartment. This reduces the need for fasteners. This also has the advantage of providing a smooth inner join within the sleeve thus inhibiting accumulation of fill that would otherwise occur with an internal seam.

The ends of the pockets may be closed by a common flap or by separate flaps. Each adjacent pair of pockets may be separated by a gusset which extends the length of the pocket and tapers down adjacent the end of the pocket. The gusset permits a quilt of uniform thickness. The effect is to create pockets of substantially rectangular cross section which in use are fully occupied by the sleeves containing fill. This promotes uniform insulation for the user.

The fill may be conventional and inserted into the sleeves by conventional techniques.

Certain embodiments of the invention are now described by way of example with reference to the accompanying drawings in which.

Figure 1:
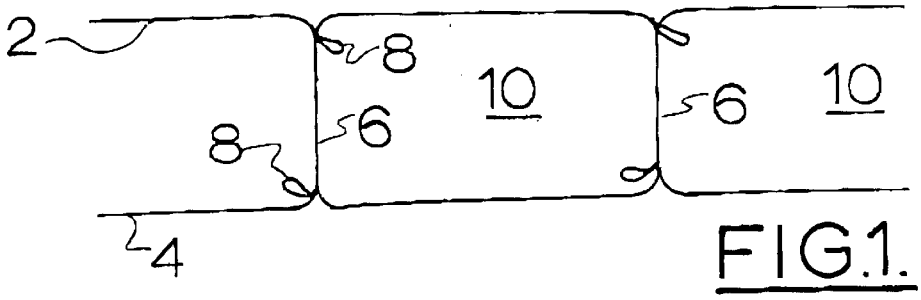
FIG. 1 is a transverse section through the quilt showing the compartments.
Figure 2:
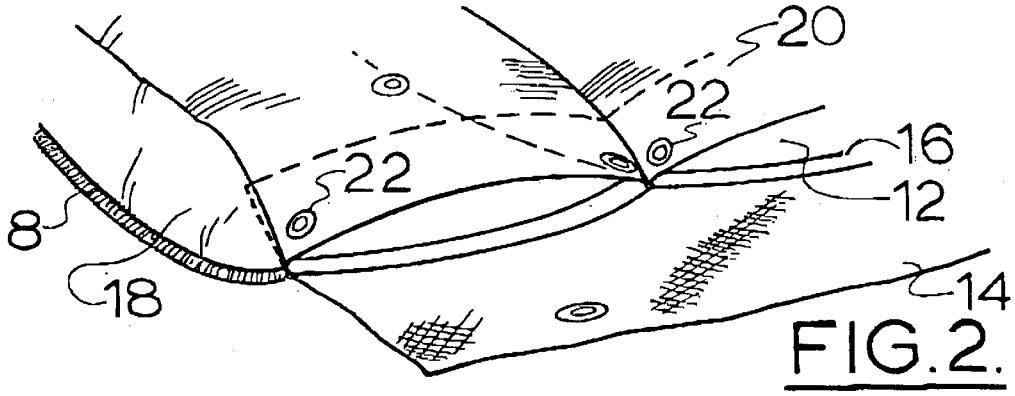
FIG. 2 is a perspective view of the quilt with sleeves removed.
Figure 3:
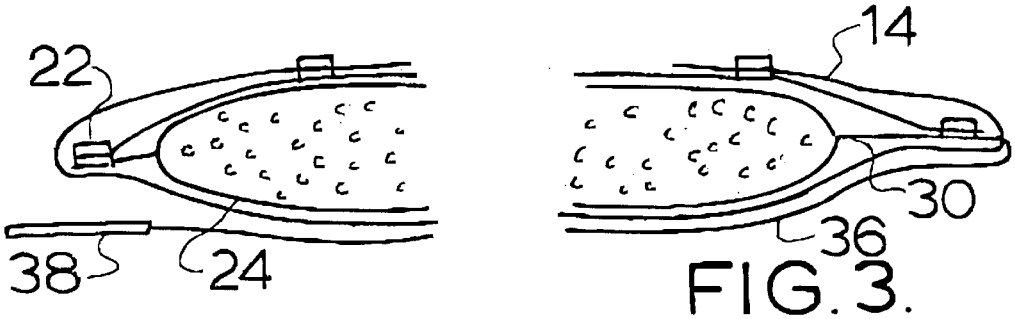
FIG. 3 is a longitudinal section of the quilt with the sleeves in position.
Figure 4:
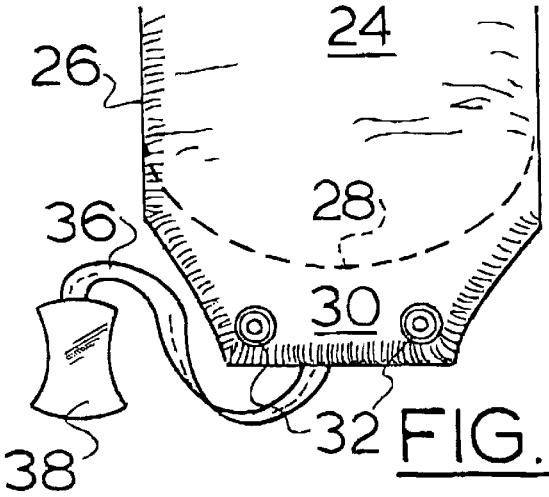
FIG. 4 is a plan view of an end of a sleeve.
Figure 5:
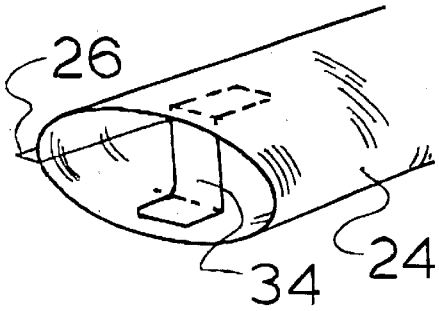
FIG. 5 is a transverse section through a sleeve showing the fill barrier.

Referring now to the drawings, the quilt is made of polyester fabric. A top wall 2 is joined to the bottom wall 4 by side-by-side tapered gussets 6 each 25 mm deep. These are incorporated in overlooked runs 8. The walls and gusset define side-by-side pockets 10 of rectangular section. The pockets are 140 mm wide. The pockets have open ends 12 which in use are closed by a common flap 14 like a pillow case.

A continuous, stabilising line tape 16 is sewn across the mouth of each pocket. The endmost 50 mm portion 18 of gusset is tapered to zero. The top wall has an overlap 20. The overlap mounts a pair of fastening domes 22 for each pocket. The opposite edge of the quilt is constructed identically. This means the pockets 10 are open at each end so that a corresponding sleeve may be inserted in one end and pulled through from the other end.

Each pocket 10 has a sleeve 180 mm wide made of a fabric tube 24 closed by an overlocked run 26. Note that the width of the sleeve is 40 mm greater than the width of the pocket. The sleeve end is closed by a semicircular seam 28.

This avoids a corner and allows the fill to move freely. The end 30 of the sleeve 30 mounts a pair of studs 32 which underlie the domes 22 in use.

The sleeves have a piece of 25 mm tape 34 sewn across the lumen of the tube at ¼, ½ and ¾ intervals to act as a shape-maintaining tie and to stabilise the fill. In an alternative and preferred arrangement there are pairs of laterally spaced ties 34 along the length of the sleeve at ¼, ½ and ¾ positions. The ties 34 do not interfere with initial filling, but limit the vertical expansion of the sleeve 24 to thereby maintain the shape of the sleeve. Once the fill is installed evenly within the sleeve, the tape or ties 34 maintain the tube shape by preventing it assuming a cylindrical form that would promote unwanted fill flow, thus the fill is stabilised within the tube by reason of this restriction. A pull through tape 36 is sewn at one end to the end of the sleeve. A plastic grip 38 is sewn to the free end of the tape.

It will be appreciated that, due to the greater width of the sleeve relative to the pocket and the shape-maintaining ties 34, as the sleeves are laid flat within the pockets, the sleeve will over-fill the pocket width-wise and gusset 6 will tend to assume a diagonal configuration so that marginal edge portions of adjacent sleeves will overlap so that gaps between the sleeves will not be readily discernible in the assembled quilt and cold spots will not be perceived by the user.

In use, the end flaps are released in order to give access to the quilt and studs which are all unsnapped. The sleeves are withdrawn and folded to be immersed and washed in a solution which kills dust mites. The sleeves are transferred to a spin dryer and then dried outside or tumble dried. The quilt is laundered conventionally once the sleeves have been removed.

When ready for reassembly, a grip 38 is fed through an empty pocket 10. The tape pull through 36 is drawn through the pocket dragging the sleeve through the pocket where upon the domes are snapped shut.

When the quilt is made of irregular or non-tubular compartments the fabric sleeve conforms to the shape of the compartment and an entrance of suitable size is made during construction.

We have found the advantages of the above embodiment to be:

1. Sewing the quilt does not require large areas of fabric to be fed through the overlocker.
2. The sleeves may be substituted by spares or are of convenient size for drying after laundering. Complete rapid drying is attainable.
3. The fill is less likely to clump.

Whilst the above has been given by way of illustrative example of the present invention many variations and modifications thereto will be apparent to those skilled in the art without departing from the broad ambit and scope of the invention as herein set forth in the appended claims.

The claims defining the invention as fallows:

1. A quilt assembly having multiple compartments holding fill wherein each compartment has an upper surface and an opposed surface, said surfaces extending generally parallel to the plane of the quilt when the quilt is laid out flat, the fill being spread along each compartment between the surfaces, at least one flexible connector within each compartment, bridging between said surfaces, and constraining each compartment to a substantially flat profile but permitting manual manipulation of fill along each compartment and past the flexible connector, the dimensions of each compartment and the length of each flexible connector being selected to maintain the substantially flat profile and thereby stabilize fill within each compartment in order to resist its migration in use.

2. A quilt assembly as claimed in claim 1 wherein each compartment comprises a removable sleeve located inside a pocket.

3. A quilt assembly as claimed in claim 2 wherein the sleeves are closed at opposite ends by corner less seams.

4. A quilt assembly as claimed in claim 2 wherein the sleeves each have an integral pull through capable of being fed through the pocket in order to draw the sleeve into the pocket.

5. A quilt assembly as claimed in claim 2 wherein the pockets are made from a top sheet and a bottom sheet joined by gussets extending between the sheets creating rectangular cross section pockets.

6. A quilt assembly as claimed in claim 5, wherein the gussets taper at or near the ends of the pockets.

7. A quilt assembly as claimed in claim 2 wherein each sleeve has unfilled ends carrying fasteners which co-operate with fasteners associated with each pocket thereby retaining the sleeve in position within the said pocket.

8. A quilt assembly as claimed in claim 1 wherein each flexible connector provides a blocking function to longitudinal movement of fill along the associated compartment.

9. A quilt assembly as claimed in claims wherein the compartments are side by side with aligned ends with each set of aligned ends having respective openings being closed by a common flap.

10. A quilt assembly as claimed in claim 1 wherein each compartment has the a plurality of longitudinally spaced flexible connectors.

11. A quilt assembly as claimed in claim 10 wherein each compartments has a plurality of pairs of longitudinally spaced flexible connectors.

12. A quilt assembly having multiple compartments holding fill wherein each compartment has an upper surface and an opposed surface, said surfaces extending generally parallel to the plane of the quilt when the quilt is laid out flat, the fill being spread along each compartment between the surfaces, at least one flexible connector means within each compartment and bridging between said surfaces, the flexible connector means constraining each compartment to a substantially flat profile but permitting manual manipulation of fill along each compartment and past the flexible connector, the dimensions of each compartment and the length of each flexible connector means being selected to maintain the substantially flat profile and thereby stabilize fill within each compartment in order to resist its migration in use.

* * * * *

UNITED STATES PATENT AND TRADEMARK OFFICE

CERTIFICATE OF CORRECTION

PATENT NO. : 6,725,478 B2
DATED : April 27, 2004
INVENTOR(S) : Betty Birch

It is certified that error appears in the above-identified patent and that said Letters Patent is hereby corrected as shown below:

Column 3,
Line 57, “fallows” should read -- follows --.

Column 4,
Line 34, “claims” should read -- claim 1 --.
Line 39, “compartment has the a” should read -- compartment has a --.
Line 42, “compartments has” should read -- compartment has --.
Line 49, “surfaces, at least one flexible” should read -- surfaces, the flexible --.

Signed and Sealed this

Twenty-first Day of June, 2005

JON W. DUDAS
*Director of the United States Patent and Trademark Office*